United States Patent [19]

Mahon

[11] 4,453,831

[45] Jun. 12, 1984

[54] MIXER WITH A FIXED DRUM

[75] Inventor: Jean Mahon, Bondues, France

[73] Assignee: Societe Anonyme Couvrot Laine & Cie, Croix, France

[21] Appl. No.: 400,962

[22] Filed: Jul. 22, 1982

[30] Foreign Application Priority Data

Jun. 4, 1982 [FR] France ..... 82 10270

[51] Int. Cl.[3] ..... B28C 5/08

[52] U.S. Cl. ..... 366/65; 366/66; 366/244

[58] Field of Search ..... 360/64, 65, 66, 287, 360/288, 279, 244, 261, 241

[56] References Cited

U.S. PATENT DOCUMENTS 2,717,147 9/1955 Fejmert ..... 366/65
3,109,632 11/1963 Wiegel ..... 366/66

FOREIGN PATENT DOCUMENTS 785369 10/1957 United Kingdom ..... 366/66
910044 11/1962 United Kingdom ..... 366/66

*Primary Examiner*—Robert W. Jenkins
*Attorney, Agent, or Firm*—Robert E. Burns; Emmanuel J. Lobato; Bruce L. Adams

[57] ABSTRACT

The invention relates to a mixer with a fixed drum.

According to the invention, the mixer comprises a central opening (6) which makes it possible to carry out measurements or operations directly in the mixture during mixing. The entire driving device (8) is located around a central pipe (7). It comprises inter alia a movable ring (9) set in rotation by a drive member (5), the mixing arrangement (3) being fixed to the ring (9) and is set in rotation through the intermediary of a receiving pinion (17) meshing with a fixed wheel (15) connected to the central pipe (7).

The invention will be used in particular for mixing wet or dry constituents such as concrete, silica sand and the like.

5 Claims, 2 Drawing Figures

MIXER WITH A FIXED DRUM

BACKGROUND OF THE INVENTION

The invention relates to a mixer with a fixed drum. It will be used for achieving thorough mixing of dry or wet constituents, such as, for example, for the manufacture of concrete, refractory products, silica sand and the like.

Mixers comprise a generally circular drum in which the various constituents of the mixture are placed and a mixing arrangement which is composed of movable blades, generally set in rotation, these blades promote thorough mixing of the constituents, the entire mixing arrangement being moved in the drum in order to homogenize the entire mixed product.

There are two major categories of mixer; mixers comprising a rotary drum in which the position of the mixing arrangement is fixed, on the other hand, the drum carries out a rotary movement which entrains the product and periodically subjects it to the action of the mixing arrangement. Thus it is possible to homogenize the entire mixed product, however it should be noted, in this type of mixer, that the heaviest and bulkiest part of the machine is set in rotation.

Then there are mixers with a fixed drum, in which the drum containing the product is fixed whereas the mixing arrangement, apart from its rotary movement about its own axis, is rotated in the drum, which causes the blades to describe an epicyclic movement, which makes it possible to move all the product located in the drum and thus to homogenize it. The entire device for driving the mixing arrangement is located in a rotary casing of large dimensions, in view of the forces introduced and consequently this type of mixer is particularly suitable for manufacture in large numbers in view of the fact that the least modification in the dimensions of the gears makes it necessary to revise the shape of the casing, which cannot be envisaged reasonably if one wishes to obtain a relatively low final cost price. Apart from the fact that it cannot be easily adapted to different conditions of use, the mixer comprising a fixed drum also has the drawback that the upper part of the drum is not easily accessible when it is in operation, since it is perpetually swept by the moving mixing arrangement and the central part of the drum is occupied by the drive member which actuates the mixing arrangement by means of its driving device. Consequently, it cannot be envisaged, for example, to add to the mixing arrangement any tool such as a motorized mixing screw which would be fitted in the drum as an accessory in order to perfect mixing.

SUMMARY OF THE INVENTION

The main object of the present invention is to provide a mixer with a fixed drum in which consequently the mixing arrangement is movable and which in its upper part comprises a central opening providing direct access to the mixture. In this way, the mixer of the invention benefits from the advantages of the mixer having a fixed drum, i.e. greater simplicity and less bulk than mixers having a movable drum, whilst also benefiting from the advantages of mixers with a movable drum, i.e. possible access to the mixture during the operation of the mixer without being impeded by the movement of the mixing arrangement, which in particular makes it possible to effect measurements by introducing probes into the mixture or resolving particular problems by fitting auxiliary tools such as a mixing screw.

Another object of the present invention is to provide a mixer with a fixed drum which can be easily adapted to the characteristics of the product to be mixed. In particular as regards the speed of rotation of the mixing arrangement as well as its speed of movement in the mixture, the latter can be easily modified by altering the dimensions of the pinions present in the driving device of the mixing arrangement without it being necessary to create a new shape of casing for each instance. In addition, the power necessary for driving the mixing arrangement, which will depend on the product to be mixed, can easily be adjusted according to the present invention, owing to the fact that the mixer can be equipped with one or more motors which may also be motors having a different power rating.

Other objects and advantages of the present invention will become apparent from the ensuing description, which however is given solely by way of example and is not intended to limit the latter.

The mixer having a fixed drum intended in particular for mixing wet or dry constituents such as concrete, refractory products or silica sand and the like, comprising a fixed drum into which the constituents to be mixed are introduced, a mixing arrangement, constituted by blades driven in an epicyclic movement by a drive member is characterised by the fact that it comprises in its upper part, a central opening giving direct access to the mixture through a central pipe.

BRIEF DESCRIPTION OF THE DRAWING

The invention will be better understood on referring to the ensuing description and to the accompanying drawings which form an integral part thereof.

DESCRIPTION OF THE PREFERRED EMBODIMENT

Figure 1:
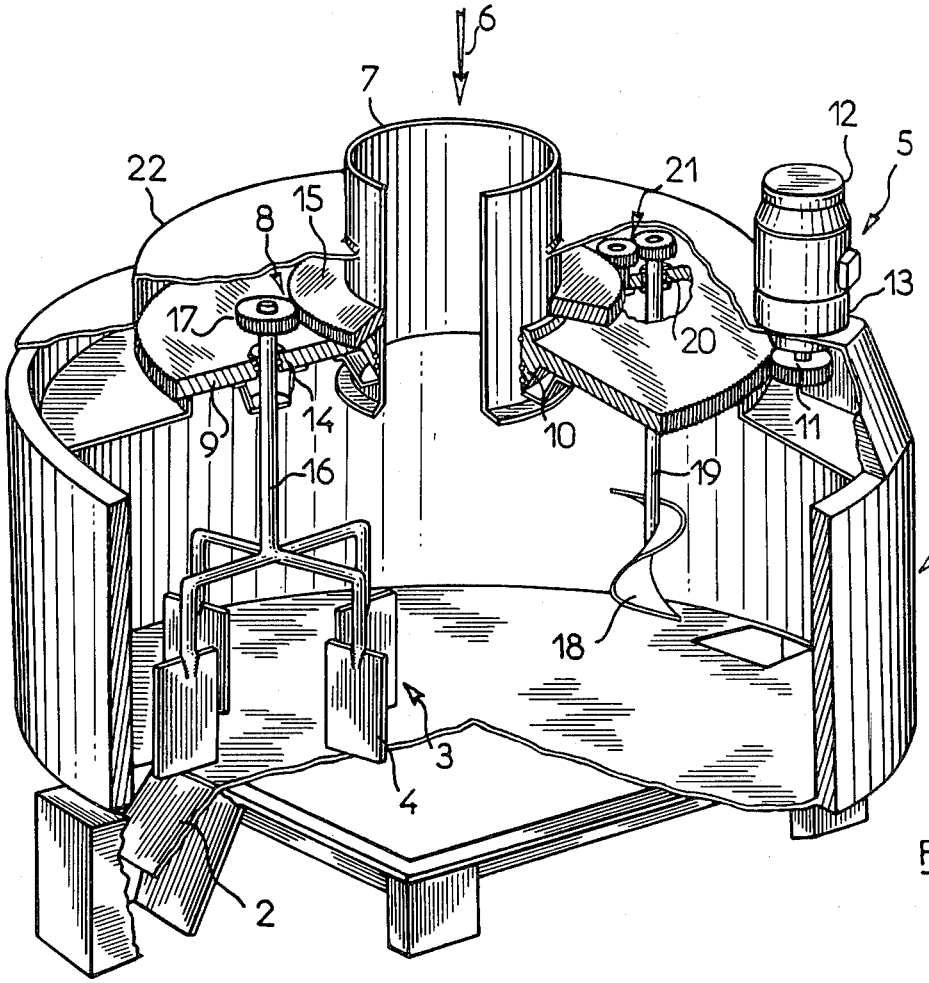
FIG. 1 is a diagrammatic front view in section of the mixer comprising a fixed drum of the invention.

FIG. 1 shows a mixer with a fixed drum illustrated according to a preferred embodiment of the latter.

The mixer comprises a fixed drum 1 which is preferably made of circular shape, this drum is intended to contain the various constituents of the mixture. These constituents may also be wet or dry and may serve for example to obtain concrete, refractory products, silica sand for producing glass or the like. As in the case of traditional mixers with a fixed drum, the drum 1 is equipped, in its lower part, with a trapdoor 2 which serves for the discharge of the mixture when the latter has been thoroughly mixed.

The drum 1 of the mixer is also equipped with a mixing arrangement 3 equipped with blades 4, it could easily be envisaged to arrange several mixing arrangements in the drum 1. However, in the majority of cases, a single mixing arrangement 3 will be sufficient. First of all, the mixing arrangement is set in rotation about its own axis and also describes a rotary movement in the drum 1, enables it to stir all the constituents of the mixture present in the drum. The blades 4 thus describe an epicyclic movement in the drum 1.

The mixing arrangement 3 is propelled by a drive member 5 which is preferably fixed. In fact, it could be envisaged to locate the drive member 5 at the end of the shaft of the mixing arrangement 3, however, in this case, the drive member would describe circles about the drum and consequently this would result in complications as regards the supply of electrical power, if it were an electric motor, to the drive member 5.

According to the present invention, the mixer with a fixed drum comprises in its upper part a central opening 6 through which it is possible to have direct access to the mixture present in the drum. This central opening 6 in particular facilitates the filling of the drum with the constituents of the mixture and makes it possible to introduce probes or special tools into the mixture during mixing, in the case where the central part of the drum 1 located below the central opening 6 is not swept by the mixing arrangement 3. In this latter case, it is also possible to fix the blades 4 through the intermediary of horizontal shafts, in which case certain parts of the mixture would remain accessible in the case where even the lower central part of the mixture is swept by the mixing arrangement. The central opening 6 is defined by a fixed central pipe 7.

The device 8 for driving the mixing arrangement 3 propelled by the drive member 5 is distributed around the central pipe 7.

Figure 2:
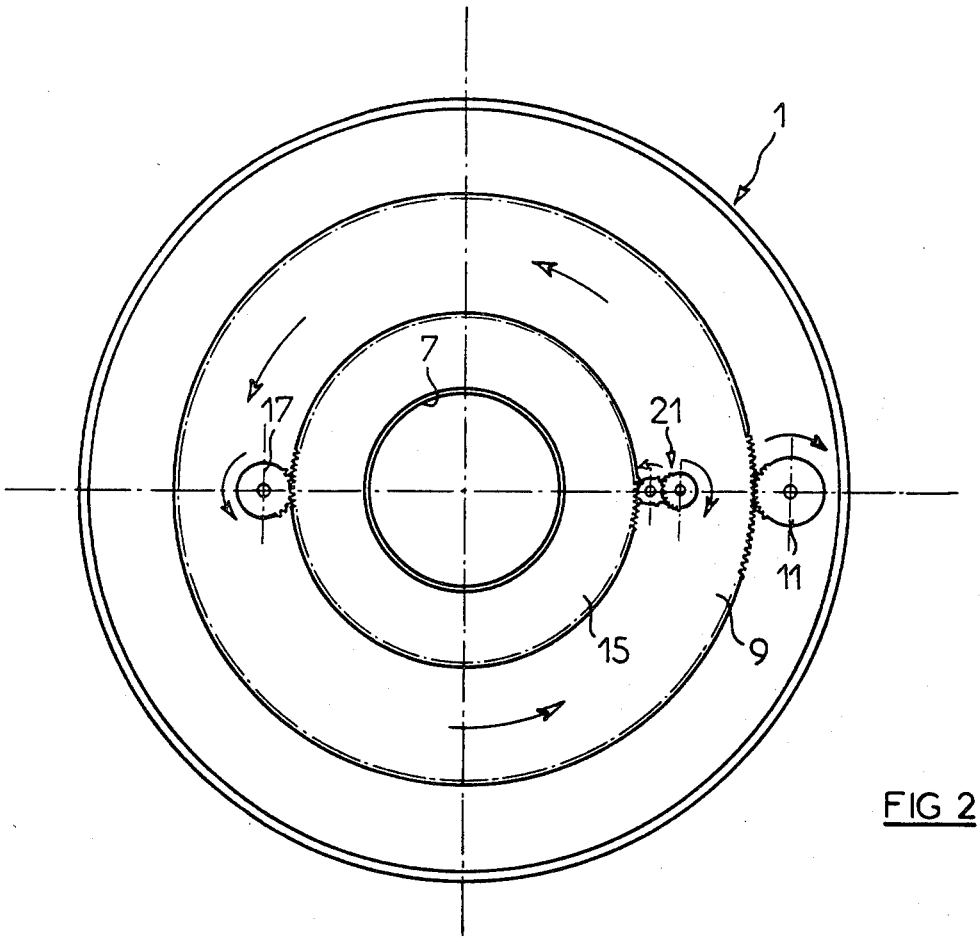
FIG. 2 is a plan view of the mixer of the invention in the vicinity of the device for driving the mixing arrangement.

The driving device 8 illustrated in FIGS. 1 and 2 is composed in particular of a ring 9 which is able to rotate and is driven by the drive member 5. The ring 9 is set in rotation about the central pipe 7 on which it is centered. The ring 9 is located for example on the pipe 7 through the intermediary of a ball bearing box 10.

The ring 9 will be set in rotation through the intermediary of a driving pinion 11 located at the end of the shaft of the drive member 5. In view of the relatively slow speeds used for moving the mixing arrangement, in general, the drive member 5 is divided into a motor 12 followed by reduction gearing 13, the arrangement forming a speed-reducer unit. The speed-reducer arrangement 5 is fixed and, for example, could be connected to the drum 1.

In view of the relatively considerable forces to be transmitted in general to the mixing arrangement, a toothed ring 9 and a toothed driving pinion 11 are advantageously used.

In the case of FIGS. 1 and 2, the use of only one drive member 5 has been envisaged, however, as shown in FIG. 2, it could easily be envisaged to arrange several drive members 5 on the periphery of the ring 9 in order to increase the mixing power. It is possible to use drive members of the same or different power, the only imperative being that the tangential speed in the region where the driving pinion of the drive member meshes with the ring 9 is substantially identical.

This ring 9 serves as a support for the mixing arrangement 3 on which it is mounted to rotate freely, a bearing box 14 is used for this purpose. The circular movement of the rotary arrangement 3 has thus been organized.

For rotating the mixing arrangement about its own axis, a fixed wheel 15 is advantageously be located around the pipe 7, on which it is fixed and centered. A receiving pinion 17 is located on the drive shaft 16 of the mixing arrangement 3, which pinion 17 meshes with the fixed wheel 15. Thus, when the mixing arrangement 3 is set in general rotation around the drum 1, it will simultaneously be rotated about its own axis by means of the torque received from its receiving pinion by meshing with the periphery of the fixed wheel 15.

By altering the dimensions of the receiving pinion 17 and of the fixed wheel 15, it will be seen that it is very easy to modify the speed of rotation of the mixing arrangement 3. Similarly, due to the choice of speed-reducer 13, it is easy to adapt the speed of the circular movement in the drum 1 of the mixing arrangement 3.

As was mentioned above, it is very easy to arrange several mixing arrangements in the drum 1 and it may also be envisaged to provide different tools in the drum 1, which will derive the power necessary for their drive from the power supplied by the drive member 5. One embodiment is illustrated in FIGS. 1 and 2 by the addition of a mixing screw 18. The shaft 19 of this mixing screw 18 is mounted on the ring 9 through the intermediary of a bearing box 20 similar to the bearing box 14 used for mounting the mixing arrangement 3 on the ring 9. Thus, the mixing screw will describe a circular movement identical to that described by the mixing arrangement 3. Furthermore, the rotation of the mixing screw 18 can be obtained by using a gear train 21 which meshes with the fixed wheel 15. The use of a gear train 21 makes it possible to choose a speed of rotation of the mixing screw 18 which is different from that of the mixing arrangement 3 which, in practice, will generally be necessary in view of the fact that the speed of rotation of a mixing screw 18 should be appreciably greater than that of the mixing arrangement 3.

In view of the generally corrosive nature of the constituents to be mixed, it is necessary to protect the driving device 8 by means of a sealed casing 22. This casing encloses the upper part of the drum 1 and may serve in particular for fixing the pipe 7 to the drum 1. The drive member 5 is fixed to the upper part of this casing 22 whereas the lower part of the casing 22 is made in several parts, which in principle will protect the bearing box 10, the bearing boxes 14 and 20 as well as the peripheral teeth of the ring 9 and the driving pinion 11.

It is obvious that the invention is not limited to the embodiment described previously, but that it also comprises other embodiments, which are within the scope of a man skilled in the art and which constitute equivalent means.

Thus, the drive of the pinion 17 could be produced by meshing with a fixed or movable wheel 15 with internal or external teeth.

What is claimed is:

1. A mixer for mixing wet or dry mix constituents to mix concrete silica sand and the like comprising, a fixed drum, an upstanding central pipe mounted fixed defining a central opening at the top of said drum for introducing mix constituents into the interior of the drum, a ring gear disposed supported externally of the drum coaxial with the central pipe for rotation about the pipe and relative to the drum, a motor drive coactive with the teeth of said ring gear for driving it rotationally, a mixing arrangement interiorly of said drum having a depending shaft rotationally supported on the ring gear for rotation therewith, a fixed gear mounted externally of said drum coaxial with and on said pipe, a driven pinion gear on said shaft meshing with said fixed gear for driving said depending shaft rotationally about its axis as said gear transports the mixing arrangement in a circular path in said drum and relative to said fixed gear, and the motor drive having a drive motor, a speed reducer driven thereby, and a drive pinion gear driven by the speed reducer for rotationally driving the ring gear, whereby the mixing arrangement is transported along said circular path and simultaneously driven rotationally by the motor drive.

2. A mixer for mixing wet or dry mix constituents to mix concrete, silica sand and the like according to claim 1, in which said motor drive is removably mounted peripherally of said ring gear for easily removing it and mounting a different speed reducer thereon.

3. A mixer for mixing wet or dry mix constituents to mix concrete, silica sand and the like according to claim 1, in which said mixing arrangement comprises a plurality of blades fixed to and about the first-mentioned depending shaft.

4. A mixer for mixing wet or dry mix constituents to mix concrete, silica sand and the like according to claim 1, including another shaft depending from said ring gear rotationally mounted thereon, a gear train meshing with said ring gear having a pinion fixed to said another shaft, a mixing element connected to said another shaft transported by said ring gear along a circular path interiorly of said drum and simultaneously driven rotationally by said another shaft as the ring gear is rotationally driven.

5. A mixer for mixing wet or dry mix constituents to mix concrete, silica sand and the like according to claim 4, in which said mixing element comprises a device having a helical configuration.

* * * * *